US006032596A

United States Patent [19]

Hayakawa

[11] Patent Number: 6,032,596

[45] Date of Patent: Mar. 7, 2000

[54] EMBROIDERY DATA PROCESSING APPARATUS

[75] Inventor: Atsuya Hayakawa, Chita, Japan

[73] Assignee: Brother Kogyo Kabushiki Kaisha, Nagoya, Japan

[21] Appl. No.: 09/362,658

[22] Filed: Jul. 29, 1999

[30] Foreign Application Priority Data

Aug. 5, 1998 [JP] Japan ..... 10-221568

[51] Int. Cl.[7] ..... D05C 5/02

[52] U.S. Cl. ..... 112/102.5; 112/475.19; 364/470.09

[58] Field of Search ..... 112/102.5, 470.04, 112/470.06, 475.19, 445, 454, 456, 457, 458; 364/470.07, 470.08, 470.09

[56] References Cited

U.S. PATENT DOCUMENTS 5,558,032 9/1996 Muto et al. ..... 364/470.09 X
5,784,987 7/1998 Mizuno ..... 112/102.5
5,791,270 8/1998 Mori ..... 112/445 X
5,911,182 6/1999 Uyama et al. ..... 112/102.5

*Primary Examiner*—Peter Nerbun
*Attorney, Agent, or Firm*—Oliff & Berridge, PLC

[57] ABSTRACT

In an embroidery data processing apparatus, each time an editing action is executed with respect to an embroidery pattern to be edited, the name of the editing action is stored to an edit history memory. When a certain key is operated to effect retrospective and repetitive editing control, the names of the executed editing actions stored in the edit history memory are displayed on a CRT display and, if a mouse is operated so that one of the editing actions, for example, "ENLARGE", that is three steps before the current state is directly designated by a marker M, and a "RETURN" key is operated, embroidery data in the state before execution of the designated editing action can be obtained instantly. After new processing, such as addition or deletion of editing action, is effected, editing actions, such as "LATERAL MIRROR" and "90% CLOCKWISE ROTATE", that follow the designated editing action are automatically re-executed.

18 Claims, 12 Drawing Sheets

Fig.3

13b

| ORDER | ACTION NAME |
|---|---|
| 1 | UPWARD MOVE |
| 2 | RIGHT MOVE |
| 3 | ENLARGE/REDUCE (120%) |
| 4 | LATERAL MIRROR |
| 5 | 90° CLOCKWISE ROTATE |
| | |

Fig.7

13b

| ORDER | ACTION NAME |
|---|---|
| 1 | UPWARD MOVE |
| 2 | RIGHT MOVE |
| 3 | ENLARGE/REDUCE (90%) |
| 4 | LATERAL MIRROR |
| 5 | 90° CLOCKWISE ROTATE |
| | |

Fig.10

13b

| ORDER | ACTION NAME |
|---|---|
| 1 | UPWARD MOVE |
| 2 | RIGHT MOVE |
| 3 | CHANGE SEWING START POINT |
| 4 | ENLARGE/REDUCE(120%) |
| 5 | LATERAL MIRROR |
| 6 | 90° CLOCKWISE ROTATE |
| | |

Fig.11

13b

| ORDER | ACTION NAME |
|---|---|
| 1 | UPWARD MOVE |
| 2 | RIGHT MOVE |
| 4 | LATERAL MIRROR |
| 5 | 90° CLOCKWISE ROTATE |
| | |

EMBROIDERY DATA PROCESSING APPARATUS

BACKGROUND OF THE INVENTION

1. Field of Invention

The invention relates to an embroidery data processing apparatus, and in particular to a technique associated with retrospective control under which previous embroidery data is restored which corresponds to a certain editing action selected from a plurality of editing actions that have been executed, during generation or editing of embroidery data representing an embroidery pattern to be formed by an embroidering machine, and a technique associated with re-execution control under which previously executed editing actions that follow the selected editing action are re-executed.

2. Description of Related Art

Embroidery data processing apparatuses have been put to practical use, which apparatuses generate or edit embroidery data composed of stitch position data to be supplied to an embroidering machine so as to form an embroidery pattern. Such an embroidery data processing apparatus is generally constructed such that a keyboard, a display, a coordinate input device (e.g., mouse), an image reading device (image reader), a printer, and other similar equipment, are connected to a main control unit of a personal computer.

The embroidery data processing apparatus is adapted to generate embroidery data representing a desired embroidery pattern, by reading a drawn sketch or design through an image reader, or plotting the pattern on a display using a mouse. When generating embroidery data in such manners or correcting or editing the thus generated embroidery data, the embroidery data processing apparatus is able to perform various editing actions, including rotating actions, moving actions, enlarging or reducing actions, lateral or vertical inverting actions, and so forth.

Where such editing actions as "UPWARD MOVE", "RIGHT MOVE", "90° CLOCKWISE ROTATE", "LATERAL MIRROR (inversion)", and "ENLARGE (120%)" are successively performed on generated embroidery data representing an image of a "panda", for example, the names of these editing actions are successively stored as an edit history in the order of execution of the actions. In the meantime, the pattern of the "panda" represented by the latest embroidery data resulting from the editing actions appears on a display. Upon looking at the pattern on the display, the user may wish to change the degree of rotation, the third one of the five editing actions that have been executed, namely, change "90° CLOCKWISE ROTATE" to "75° CLOCKWISE ROTATE", for example.

In this case, if an "UNDO" key is operated once, embroidery data obtained just after execution of the editing action "LATERAL MIRROR" (one step prior to the latest state) can be restored based on the edit history, and, if the "UNDO" key is operated twice, embroidery data obtained after execution of the editing action "RIGHT MOVE" (two steps prior to the latest state) can be restored. In this state, the rotation angle is set to "75°", and, after "75° CLOCKWISE ROTATE" is executed, the previously executed editing actions "LATERAL MIRROR" and "ENLARGE (120%)" are designated one by one, and re-executed, thereby to generate final embroidery data of the "panda" that has been rotated clockwise by 75° and enlarged to 120% of the original.

In the known embroidery data processing apparatus, embroidery data representing a pattern to be formed by an embroidering machine is generated or edited with reference to the pattern on a display, and the UNDO key is provided which is operated to restore embroidery data to the state before execution of the latest or last-executed editing action. When a certain editing action selected from the previously executed editing actions, for example, the third one as counted from the latest editing action, is to be corrected or changed, therefore, the UNDO key needs to be operated a plurality of times so as to restore embroidery data to the state three or four steps before the latest action for correction thereof, resulting in a reduced operating efficiency. Also, each time the UNDO key is operated, a certain amount of time is needed for computing embroidery data in the state one step before the latest action. If the UNDO key is to be operated many times, therefore, a large amount of computing time is required, resulting in a reduced operating efficiency in the correcting procedure.

Furthermore, after embroidery data corresponding to the selected editing action is restored by operating the UNDO key, and the editing action is corrected or changed as desired, the plurality of editing actions that followed the selected editing action are re-designated one by one, and the editing actions are successively re-executed. Thus, a re-executing operation is required for each of the editing actions following the correction, resulting in reduced operating ease or efficiency.

SUMMARY OF THE INVENTION

It is therefore an object of the invention to provide an embroidery data processing apparatus wherein a certain action can be directly designated or selected from a plurality of editing actions that have been executed, assuring an improved efficiency in the correcting procedure, wherein the previously executed editing actions that follow the designated action are automatically re-executed after new processing is effected on embroidery data that was restored by designating the above editing action.

To accomplish the above object, the invention provides an embroidery data processing apparatus for generating or editing embroidery data using display means, the embroidery data representing an embroidery pattern to be formed by an embroidering machine, which apparatus comprises edit history storage means for successively storing a plurality of editing actions in an order in which the editing actions are executed, such that each of the editing actions is stored to the edit history storage means when each editing action is performed on an embroidery pattern displayed on the display means; data storage means for storing embroidery data generated upon execution of each of the editing actions, as the latest embroidery data, so that the embroidery data in the data storage means is updated; edit history display control means for causing the display means to display the editing actions stored in the edit history storage means in the form of characters or symbols, in an order in which the editing actions are stored to the edit history storage means; editing action designating means for directly designating a selected one of a plurality of previously executed editing actions that are displayed on the display means by the edit history display control means; and embroidery data restoring means for obtaining embroidery data in a state when the editing action designated by the editing action designating means was performed, as the latest embroidery data.

Each time an editing action, such as "ROTATION" or "INVERSION", is performed on an embroidery pattern to be edited that is displayed on the display means, the edit history storage means stores the executed editing action, and the data storage means stores embroidery data generated upon execution of each editing action, such as "ROTATION" or "INVERSION", as the latest embroidery data. Thus, the embroidery data in the data storage means is updated for each editing action. In returning to any one of the editing actions that have been executed, the edit history display control means displays the editing actions stored in the edit history storage means in the form of characters or symbols, in the order of storage of these actions, thus allowing the editing action designating means to designate one of the executed editing actions displayed on the display means. At the same time, the embroidery data restoring means operates to restore embroidery data to the state just before or after the editing action designated by the editing action designating means, as the latest embroidery data.

With the above arrangement, the embroidery data obtained just before or after the designated editing action can be restored at a time or instantly irrespective of whether the executed editing action designated by the editing action designating means is one step or three or four steps before the latest editing action. Thus, the apparatus of the invention can be more easily operated, while requiring a significantly reduced computing time for obtaining desired embroidery data, and assuring an improved efficiency in the correcting procedure.

In a preferred form of the invention, the editing action designating means can directly designate a certain action out of a plurality of editing actions that have been executed.

In this case, a certain editing action that is three or four steps before the latest or last-executed editing action can be directly designated or selected from the plurality of editing actions that have been executed, thus assuring increased ease with which the apparatus is operated, and improved efficiency in the correcting procedure, while significantly reducing the computing time for obtaining desired embroidery data.

In another preferred form of the invention, the editing action designating means is able to designate a certain action by undoing a plurality of executed editing actions one by one, namely, undoing one editing action at a time.

In this case, certain editing actions can be successively designated, as in the known apparatus, by undoing the executed editing actions one by one while selecting one action at a time.

In a further preferred form of the invention, the apparatus further includes command generating means for generating a command for new processing on the embroidery data in the state when the editing action designated by the editing action designating means was performed; and an editing action re-executing means for successively re-executing the previously executed editing actions that follow the editing action designated by the editing action designating means, when the new processing is effected in response to the command generated by the command generating means.

In this case, the command generating means is adapted to generate a command to effect new processing, such as addition of an editing action or deletion or change of the designated editing action, with respect to embroidery data in the state before or after the editing action designated by the editing action designating means. When the processing according to the command is effected, the editing action re-executing means serves to successively execute the previously executed editing actions that follow the editing action designated by the editing action designating means. Thus, the apparatus of the invention need not generate commands to re-execute the previously executed editing actions following correction of the designated editing action, assuring improved operating ease and efficiency.

In the above form of the invention, the processing according to the command generated by the command generating means may be selected from addition of a new editing action, deletion or change of the editing action designated by the editing action designating means.

In this case, deletion or change of the editing action designated by the editing action designating means, as well as addition of a new editing action, can be additionally performed on the embroidery data in the state just before or after execution of the editing action designated by the editing action designating means.

In another preferred form of the invention, the edit history display control means causes the display means to display contents of the editing actions in the form of symbols, using icons.

In this case, the contents of the editing actions, which are displayed in the form of symbols using icons, can be easily recognized at a glance, and a display region showing the contents of the editing actions can be reduced in size.

According to another aspect of the invention, there is provided a computer-readable storage medium that stores an embroidery data processing program for generating or editing embroidery data using display means, the embroidery data representing an embroidery pattern to be formed by an embroidering machine, comprising edit history storage means for successively storing a plurality of editing actions in an order in which the editing actions are executed, such that each of the editing actions is stored to the edit history storage means when each editing action is performed on an embroidery pattern displayed on the display means; data storage means for storing embroidery data generated upon execution of each of the editing actions, as the latest embroidery data, so that the embroidery data in the data storage means is updated; edit history display control means for causing the display means to display the editing actions stored in the edit history storage means in the form of characters or symbols, in an order in which the editing actions are stored to the edit history storage means; editing action designating means for directly designating a selected one of a plurality of previously executed editing actions that are displayed on the display means by the edit history display control means; and embroidery data restoring means for obtaining embroidery data in a state when the editing action designated by the editing action designating means was performed, as the latest embroidery data.

BRIEF DESCRIPTION OF THE DRAWINGS

The invention will be described in greater detail with reference to preferred embodiments thereof and the accompanying drawings, wherein:

FIG. 3 is a table showing a structure for data stored in an edit history memory;

FIG. 7 is a table corresponding to that of FIG. 3, in which the names of the editing actions have been changed;

FIG. 10 is a table corresponding to that of FIG. 3, in which a new editing action has been added;

FIG. 11 is a table corresponding to that of FIG. 3, wherein an editing action has been deleted.

DETAILED DESCRIPTION OF PREFERRED EMBODIMENTS

A preferred embodiment of the invention will be described in detail with reference to the drawings. In this embodiment, the invention is applied to an embroidery data processing apparatus in the form of a personal computer for purposes of description. A laptop computer could also be used as well as a processing machine specially configured to accomplish the invention.

Figure 1:
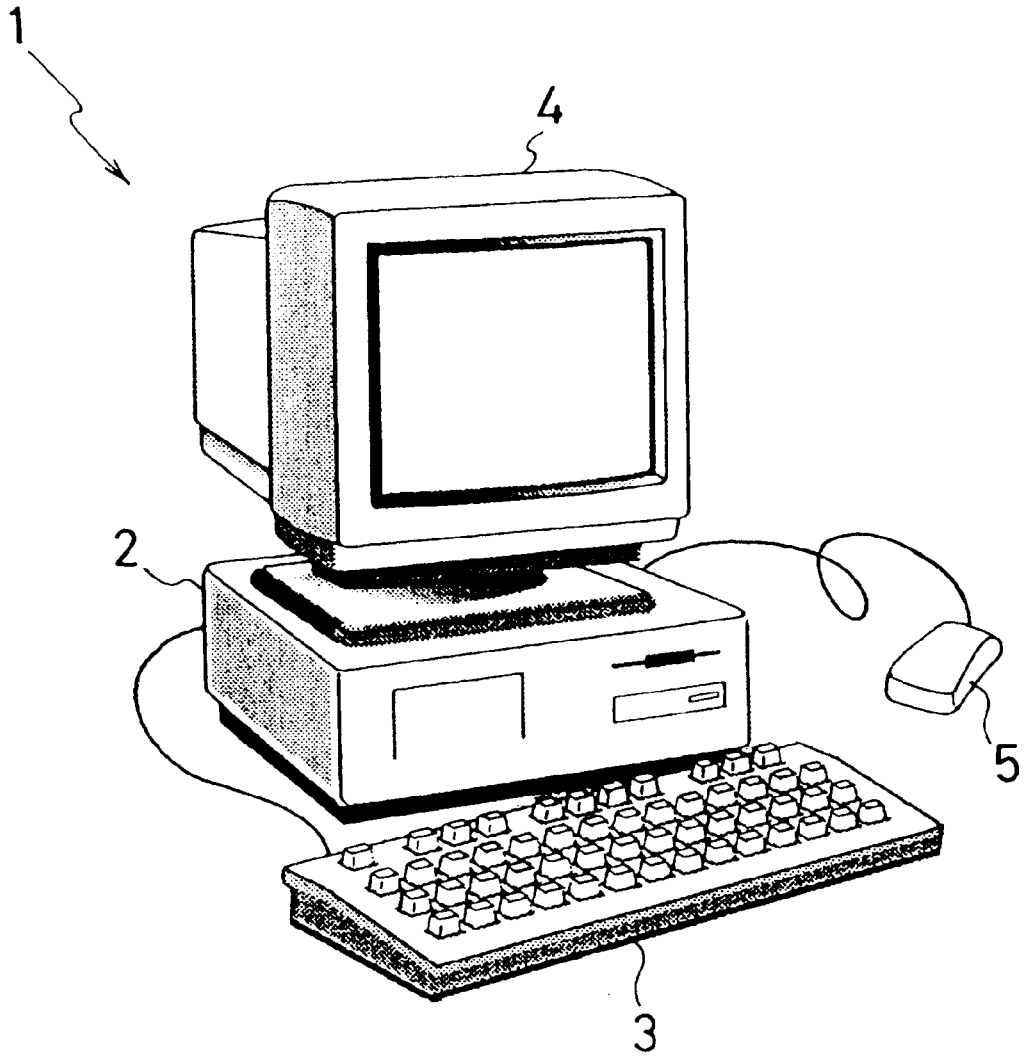
FIG. 1 is a perspective view showing an embroidery data processing apparatus according to one embodiment of the invention.
Figure 2:
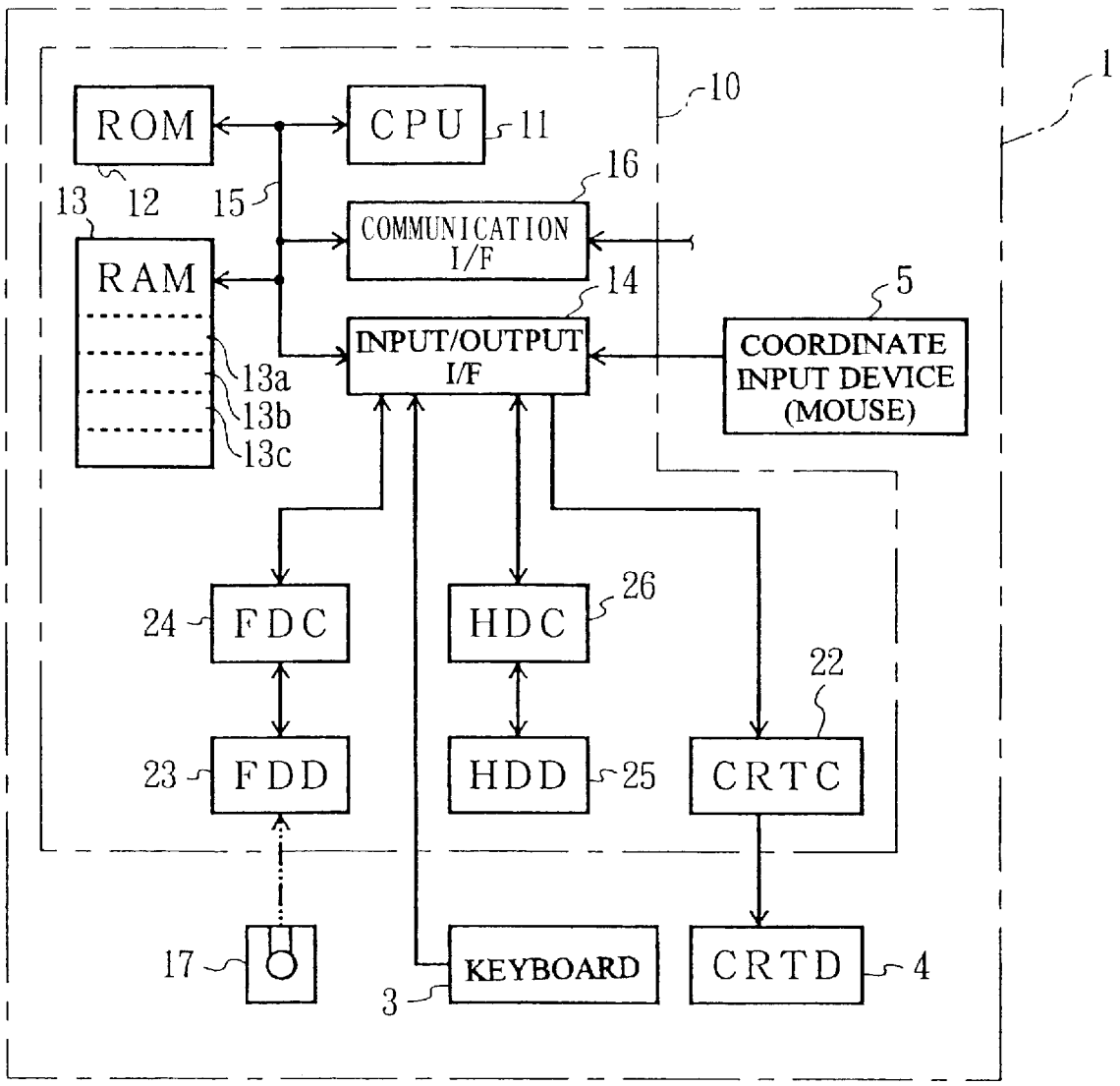
FIG. 2 is a block diagram of a control system of the embroidery data processing apparatus of FIG. 1.

As shown in FIG. 1, the embroidery data processing apparatus 1 principally comprises a control box 2 that incorporates a floppy disc drive 23, a hard disc drive 25, as shown in FIG. 2, and other storage devices as appropriate, such as CD ROM, DVD, and ZIP drive, a keyboard 3, and a CRT color display 4, a coordinate input device (e.g., mouse), and other desired peripherals, such as a scanner and a printer.

A control system of the embroidery data processing apparatus 1 will be now described.

As shown in FIG. 2, a host controller 10, provided in the control box 2, includes a CPU 11, ROM 12 and RAM 13 that are connected to the CPU 11 via a common bus 15, such as a data bus, an input/output interface 14, a communication interface (communication I/F) 16, a CRT controller (CRTC) 22 for generating display data to the CRT display (CRTD) 4, a floppy disc controller (FDC) 24 for driving and controlling the floppy disc drive (FDD) 23, and a hard disc controller (HDC) 26 for driving and controlling the hard disc drive (HDD) 25. The CRTC 22, FDC 24, and the HDC 26 are connected to the input/output interface 14.

The communication I/F 16 comprises, for example, a Centronics interface, and permits two-way data communication between the present apparatus and various types of electronic equipment, such as an external computer or a printer. To the input/output I/F 14 are connected the keyboard 3 through which characters, symbols, or the like, are entered, and the coordinate input device (or mouse) 5. As in a general personal computer, the ROM 12 stores an activation program (bootstrap loader) that activates or starts the embroidery data processing apparatus 1 when the power supply is turned on.

A hard disc mounted in the HDD 25 stores communication protocols for transmission and receipt of data to and from external terminals, and various application programs, such as word processing software, and embroidery data generation/editing software, that can be executed on the system, as well as various OS (operating systems), such as MS-DOS and Windows. The hard disc also stores control programs to be executed to perform various types of controls, such as pattern selection processing, embroidery data editing, display control, and retrospective and repetitive edit control as described later in detail.

To perform the embroidery data editing, the hard disc in the HDD 25 stores edit programs for enabling a plurality of types of editing actions or tasks, including "MOVE" for moving an object to be edited in the vertical and lateral directions, "ENLARGE" for enlarging the object at a selected enlargement ratio or magnification, "REDUCE" for reducing the size of the object at a selected reduction ratio, "MIRROR" for inverting the object upside down or laterally, and "ROTATE" for rotating the object by a selected rotating angle in a selected direction.

A floppy disk 17 removably mounted in the FDD 23 stores embroidery data (needle-drop) data indicative of a plurality of embroidery patterns, which were generated in advance using the keyboard 3, or mouse 5, such that the embroidery data are classified into some pattern categories.

The RAM 13 includes an original data memory 13*a* that stores embroidery data of an embroidery pattern to be edited, which is selected from a plurality of sets of embroidery data that were generated in advance and stored in the floppy disc 17. The RAM 13 also includes an edit history memory (corresponding to edit history storage means) 13*b* that successively stores the names of editing actions executed on the embroidery pattern to be edited, in the form of characters or numbers, upon execution of each editing action.

The RAM 13 further has an edit data memory (corresponding to data storage means) 13*c* that stores embroidery data generated as a result of each editing action executed on the embroidery data to be edited, as the latest embroidery data.

The RAM 13 further includes a data memory or work memory that temporarily stores various types of data during implementation of various controls, and a memory or memories for storing various flags, pointers, counters, and so fourth.

Figure 4:
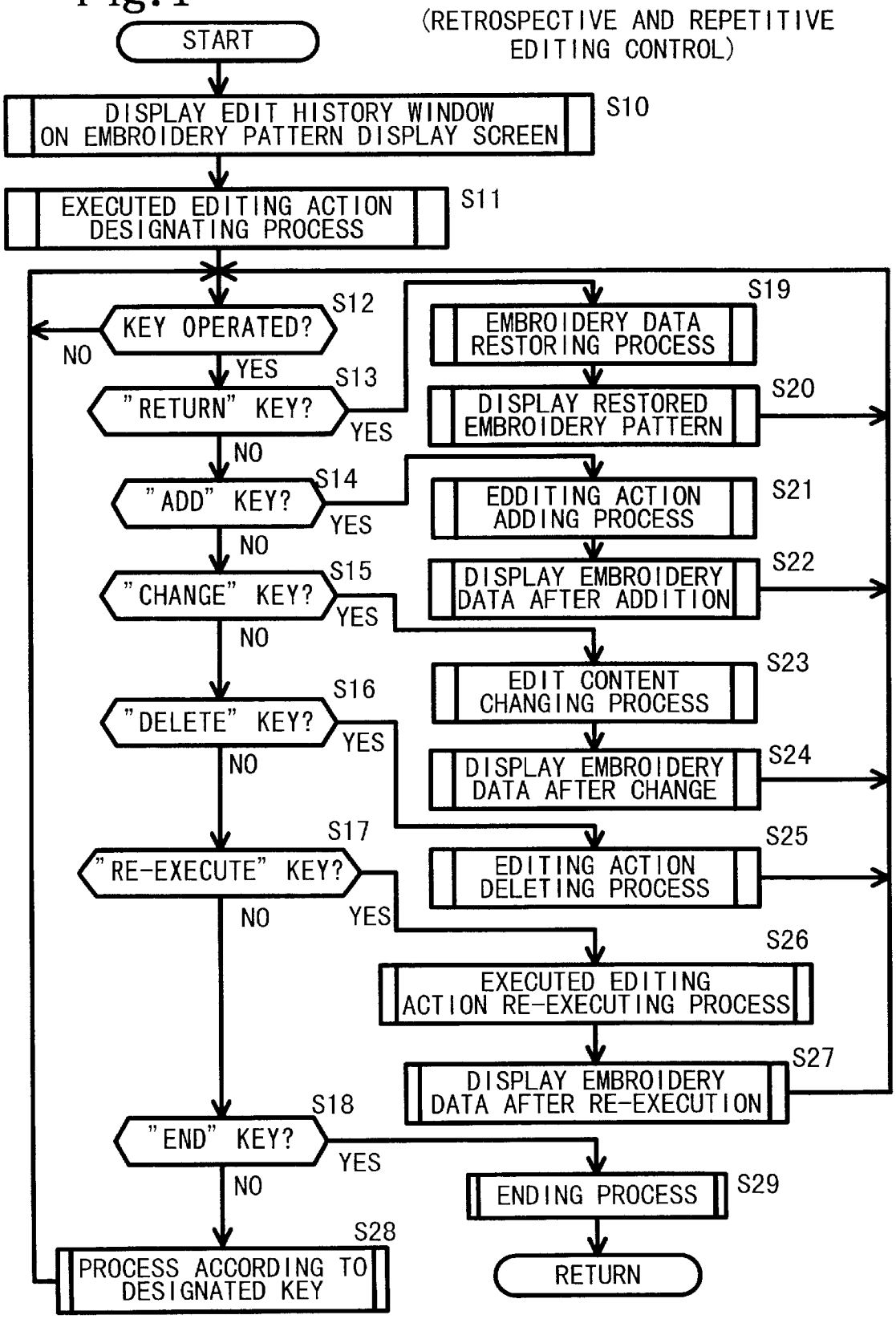
FIG. 4 is a flow chart schematically showing a routine of retrospective and repetitive editing control.

As described above, the hard disc in the HDD 25 stores a program to be executed for the above-indicated retrospective and repetitive edit control that is peculiar to the invention. Referring next to the flowchart of FIG. 4, a routine of the retrospective and repetitive edit control will be now described in detail. In FIG. 4, "Si" (i=10, 11, 12, . . . ) represents each step of the control routine.

Figure 5:
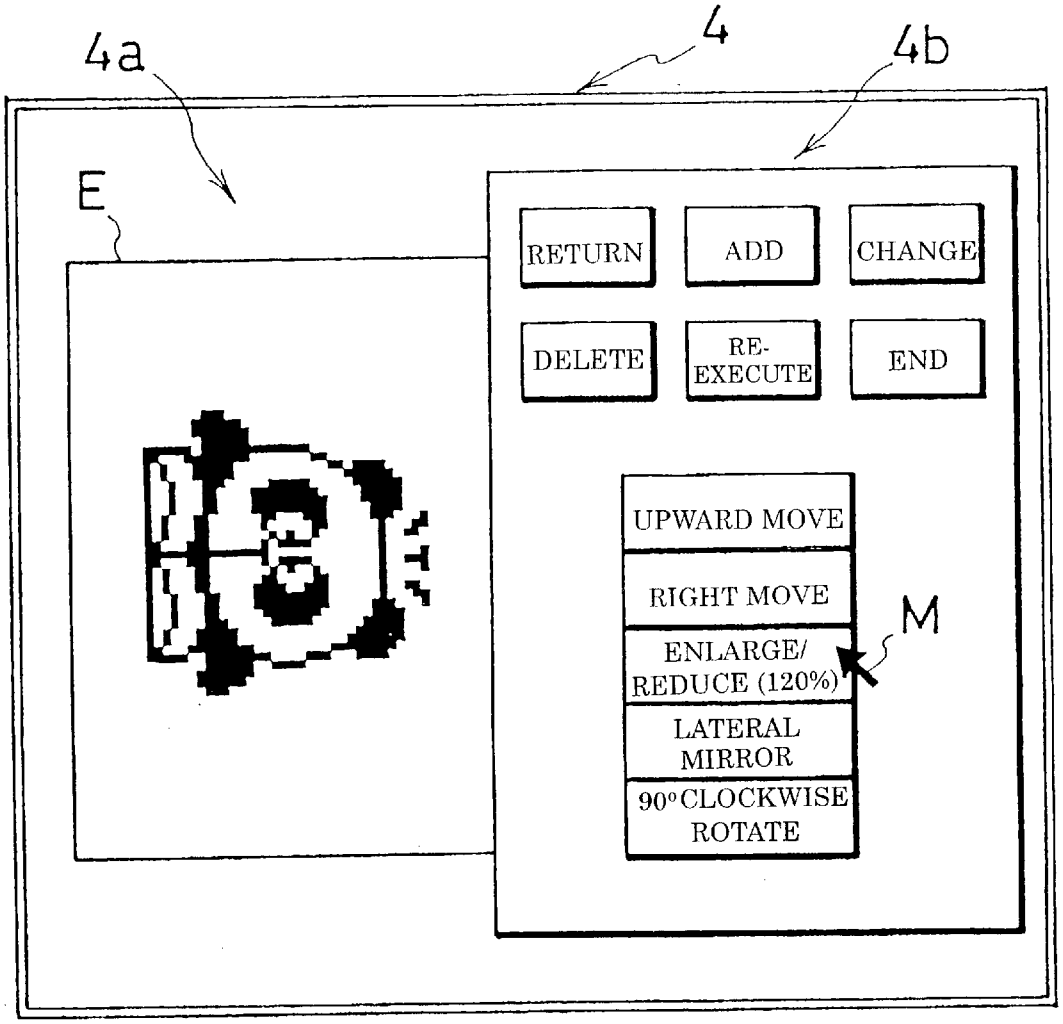
FIG. 5 is a view showing an example of a display including an embroidery pattern display screen and an edit history window.

Prior to implementation of the retrospective and repetitive edit control as described later, a pattern indicative of a "panda" (animal), for example, is selected as an embroidery pattern to be edited, as shown in FIG. 5, and embroidery data of the "panda" is stored in the original data memory 13*a* of the RAM 13. Also, editing actions (such as "UPWARD MOVE", "RIGHT MOVE", "ENLARGE/REDUCE". . . ) have been performed in this order on the embroidery data of the selected embroidery pattern.

As a result, the names of five editing actions ("UPWARD MOVE", "RIGHT MOVE", "ENLARGE/REDUCE (120%)", "LATERAL MIRROR", and "90° CLOCKWISE ROTATE") that have been executed are stored in the edit history memory 13*b* in the order of execution of the actions, as shown in FIG. 3. Also, an embroidery pattern display screen 4*a* is displayed on the CRT display 4, as shown in FIG. 5, and the embroidery pattern on which the latest editing action has been performed is displayed in a sewing region E of the display screen 4*a*, while embroidery data obtained as a result of the latest editing action is stored in the edit data memory 13*c*.

If an edit history retrieve key provided on the keyboard 3 is then operated, the retrospective and repetitive edit control routine starts being executed.

When the control routine is started, an edit history window is initially displayed in a part of the embroidery pattern display screen in step S10. For instance, the edit history window 4*b* is displayed in a generally right-half display region or area of the embroidery pattern display screen 4*a*, as shown in FIG. 5. In the edit history window 4*b* are displayed a plurality of keys, such as "ADD", "CHANGE", and "DELETE", to be operated for generating a command to perform a new operation, and function keys such as "RETURN", "RE-EXECUTE" and "END". In addition, the names of the executed editing actions, i.e., "UPWARD MOVE", "RIGHT MOVE", "ENLARGE/REDUCE (120%)", "LATERAL MIRROR", AND "90° CLOCKWISE ROTATE" are displayed in the form of characters or numbers.

Figure 6:
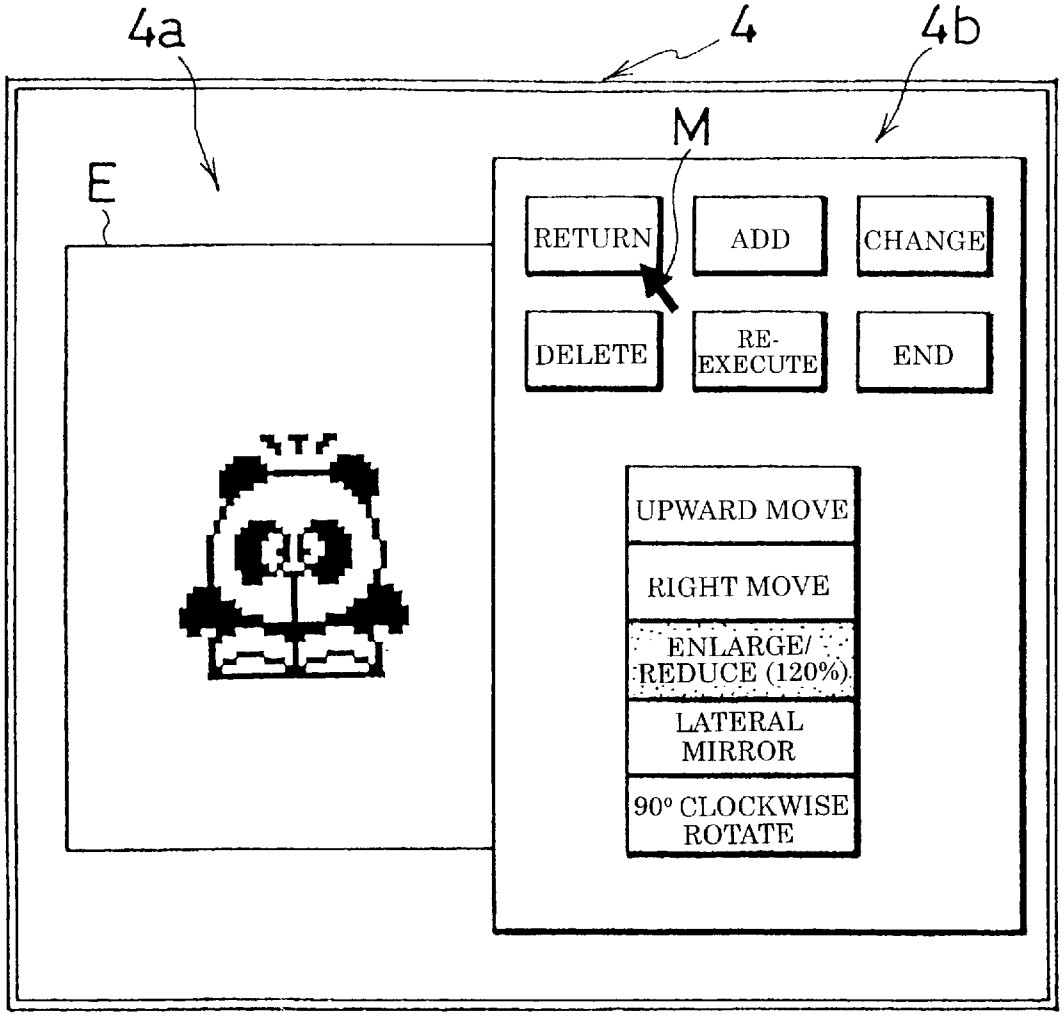
FIG. 6 is a view corresponding to that of FIG. 5, showing the state wherein embroidery data obtained before the designated editing action is restored.

In the next step S11, a process for designating one of the executed editing actions is performed. In the example of FIG. 5, the enlargement ratio of the embroidery pattern "panda" as a result of the above editing actions is found to be too large. Therefore, the editing action designating process is performed by manipulating the mouse 5 to move a marker M (corresponding to the editing action designating means) to the desired name "ENLARGE/REDUCE (120%)", and clicking the selected name. As a result, the designated edit action name "ENLARGE/REDUCE (120%)" is inverted, as shown in FIG. 6.

If the "RETURN" key is designated or pointed by the marker M (an affirmative decision (Yes) is obtained in step S12 and step S13), an embroidery data restoring process is then performed in step S19.

In the embroidery data restoring operation, embroidery data just before execution of the editing action "ENLARGE/REDUCE (120%)" designated by the marker M is restored through computing the data, by performing the editing actions "UJPWARD MOVE" and "RIGHT MOVE" on the original data of the "panda" stored in the original data memory 13*a*, according to the data stored in the edit history memory 13*b*, and the thus obtained embroidery data is stored in the edit data memory 13*c*. Then, display data of an embroidery pattern is generated from the embroidery data obtained by the restoring process, and displayed on the CRT display 4 in step S20. For example, an embroidery pattern "panda" before execution of the editing action "ENLARGE (120%)" designated by the marker M is displayed on the CRT display 4, as shown in FIG. 6.

If the "CHANGE" key is designated or selected by the marker M, namely, if an affirmative decision (Yes) is obtained in step S12, negative decisions (No) are obtained in steps S13 and S14, and an affirmative decision (YES) is obtained in step S15, an edit content changing process is performed in step S23. In the edit content changing process, a magnification setting window that allows the user to set the magnification (enlargement or reduction ratio) of the pattern is displayed as being superimposed on the edit history window 4*b*. If the user enters a numerical value (for example, 90%) indicative of a desired enlargement ratio (reduction ratio) through the keyboard 3, an enlarging or reduction action with the selected enlargement/reduction ratio is performed on the embroidery data of the edit data memory 13*c*, and the latest embroidery data resulting from this action is newly stored in the edit data memory 13*c*. Thus, embroidery data in the edit data memory 13*c* is updated.

Figure 8:
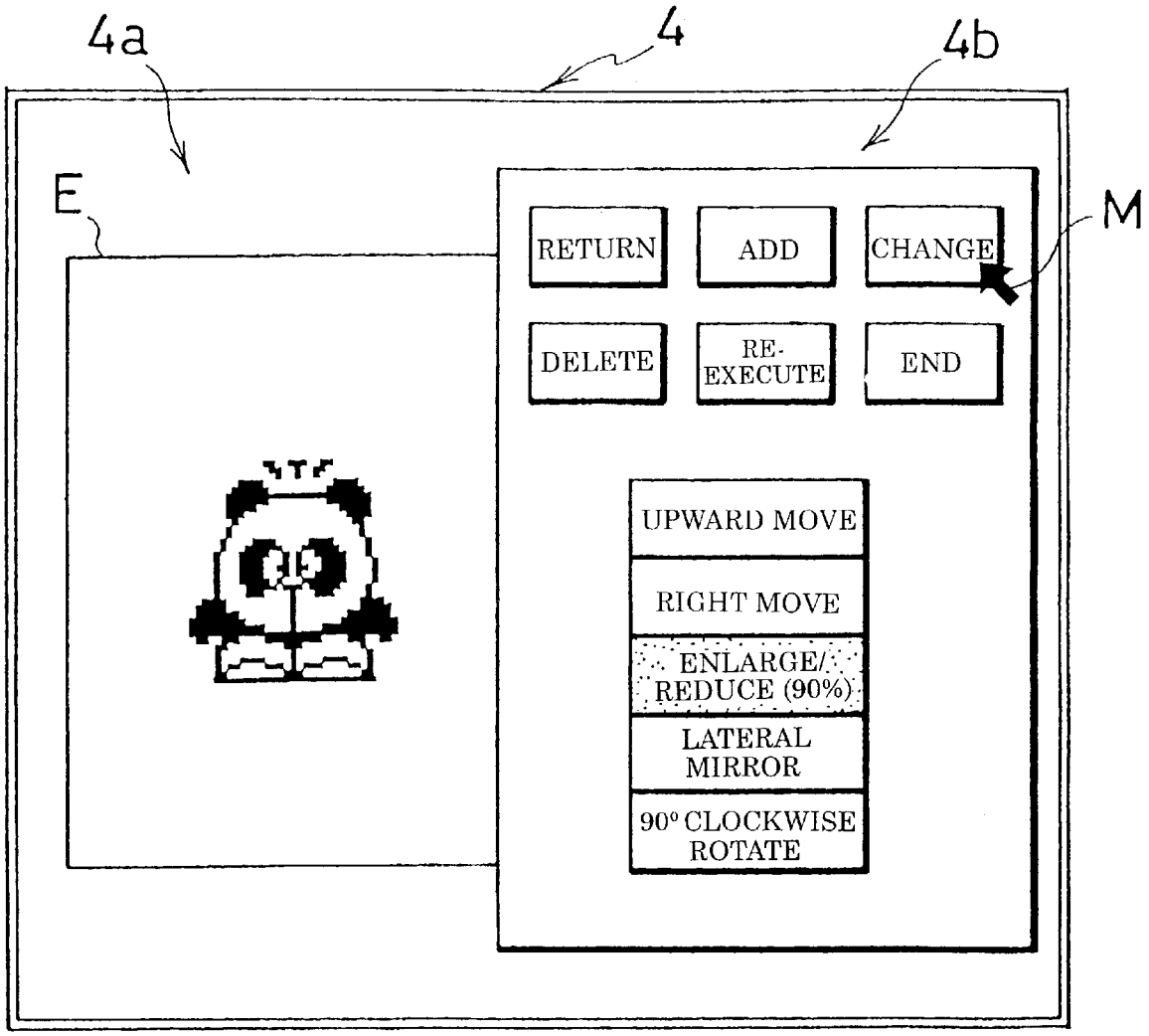
FIG. 8 is a view corresponding to that of FIG. 5, showing the state after the designated editing action has been changed.

At the same time, the new edit action name "ENLARGE/REDUCE (90%)" is written into the edit history memory 13*b*, in place of the previous name "ENLARGE/REDUCE (120%)", as shown in FIG. 7. In the next step S24, display data of the embroidery pattern after the change is generated based on the embroidery data of the edited data memory 13*c*, and displayed on the CRT display 4. For example, an embroidery pattern "panda" obtained by reducing the original pattern to 90% is displayed in the sewing region E, as shown in FIG. 8.

If the "RE-EXECUTE" key is designated or selected by the marker M, namely, if an affirmative decision (Yes) is obtained in step S12, negative decisions (No) are obtained in steps S13–S16, and an affirmative decision (Yes) is obtained in step S17, a process for re-executing the previously executed editing actions is performed in step S26.

Figure 9:
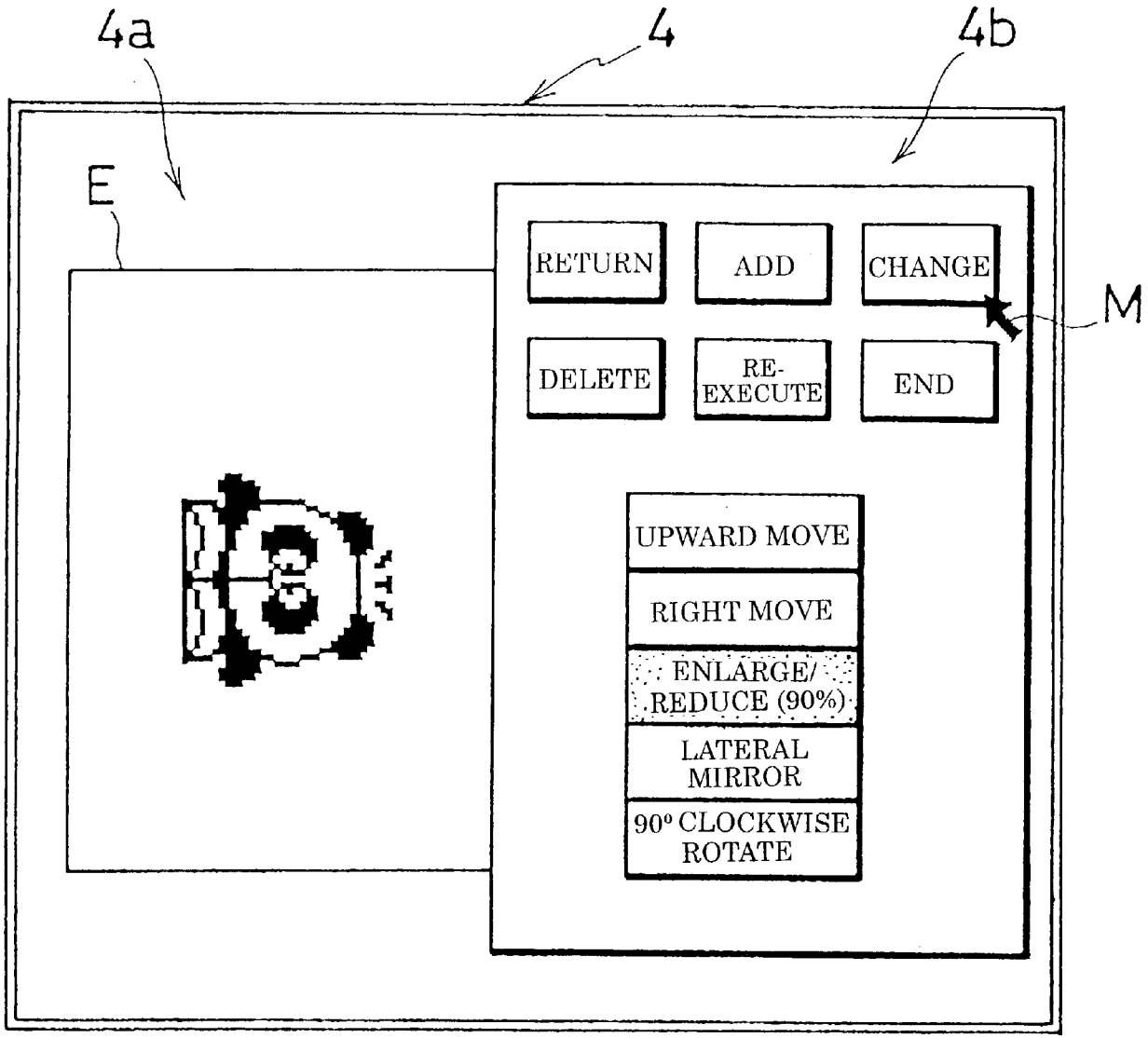
FIG. 9 is a view corresponding to that of FIG. 5, showing the state after the editing actions following the designated editing action have been re-executed.

In the re-execution process of step S26, the editing actions "LATERAL MIRROR" "90° CLOCKWISE ROTATE" that follow the editing action "ENLARGE/REDUCE (90%)" are successively executed again, and the latest embroidery data on which the editing action "90° CLOCKWISE ROTATE" has been performed is stored in the edited data memory 13*c*. Then, display data indicative of the latest embroidery pattern as a result of re-execution of the editing actions is generated, and displayed on the CRT display 4 in step S27. For example, an embroidery pattern "panda" is displayed as shown in FIG. 9 for which the enlargement/reduction ratio has been changed to 90%, as compared with that of FIG. 5, and on which "LATERAL MIRROR" and "90° CLOCKWISE ROTATE" have been successively re-executed.

When the "ADD" key is designated by the marker M, namely, if an affirmative decision (Yes) is obtained in step S12, a negative decision (No) is obtained in step S13, and an affirmative decision (Yes) is obtained in step S14, a process for adding an editing action is executed in step S21. In the editing action adding process, an editing action list window that lists a plurality of names of editing actions is displayed as being superimposed on the edit history window 4*b*. If the user selects a desired one of the editing actions by pointing it with the marker M, the designated editing action is performed on the embroidery data of the edit data memory 13*c*, and the latest embroidery data resulting from this action is stored in the edit data memory 13*c*. The data is stored in the edit data memory 13*c* at a position immediately preceding the designated one of the executed editing actions in step S11. In this example the entry is before "ENLARGE/REDUCE(120%)". Thus, the edit data memory 13*c* is updated. At the same time, the name of the added editing action, e.g., "CHANGE SEWING START POINT", is added to the edit history memory 13*b*, as shown in FIG. 10.

Then, display data indicative of the embroidery data on which the added editing action has been performed is generated from the embroidery data of the edit data memory 13*c*, and displayed on the CRT display 4 in step S22.

If the "DELETION" key is pointed or designated by the marker M, namely, if an affirmative decision (Yes) is obtained in step S12, negative decisions (No) are obtained in steps S13–S15, and an affirmative decision (Yes) is obtained in step S16, on the other hand, a process for deleting one of the editing actions is performed in step S25. In the editing action deleting process, the name of the editing action designated by the marker M is deleted. For example, the action name "ENLARGE/REDUCE (120%)" designated by the marker M is deleted from the edit history memory 13*b*, as shown in FIG. 11.

If any key other than the "RETURN" key, "ADD" key, "CHANGE" key, "DELETE" key, "RE-EXECUTE" key, and "END" key is designated by the maker M, namely, an affirmative decision (Yes) is obtained in step S12, and negative decisions (No) are obtained in steps S13–S18, a process corresponding to the designated key is performed in step S28. Finally, if the "END" key is designated by the marker M, namely, if an affirmative decision (Yes) is obtained in step S12, negative decisions (No) are obtained in steps S13–S17, and an affirmative decision (Yes) is obtained in step S18, an ending process including deletion of the edit history window 4*b* is performed in step 29, the control routine of FIG. 4 is finished, and the control flow returns to the main routine.

In the present embodiment, the CRTD 4, CRTC 22, step S11, in particular, of the retrospective and repetitive editing control, and the controller 10, connected by the data bus 15 and the input/output interface 16, provide an edit history display control means. Also, step S19, in particular, of the retrospective and repetitive editing control, and the controller 10, and others provide embroidery data restoring means. Also, the "ADD" key, "CHANGE" key, "DELETE" key, the maker M, and others provide command generating means, and the "RE-EXECUTE" key, step S26, in particular, of the retrospective and repetitive editing control, the controller 10, and others provide editing re-executing means.

As described above, each time an editing action is executed on the embroidery pattern to be edited, the name of the editing action is stored to the edit history memory 13*b*. Upon implementation of the retrospective and repetitive editing control, the names of the editing actions that have been executed and stored in the edit history memory 13*b* are displayed on the edit history window 4*b* of the CRT display 4. Thus, when the user manipulates the mouse 5 to move the marker M to the executed editing action that is three or four steps before the current state, embroidery data representing the state just before the designated editing action can be obtained instantly with one action, thus assuring improved ease and efficiency in the editing or correcting procedure, and significantly reduced operation time for computing the embroidery data.

Furthermore, when an editing action is newly added, or an editing action designated by the marker M is deleted or changed, with respect to the embroidery data representing the state just before execution of the editing action designated by the marker M, the previously executed editing actions following the editing action designated by the marker M are successively re-executed. Thus, after returning to a designated one of the executed editing actions and changing or deleting the designated action or adding a new action, the executed editing actions following the designated editing action are automatically re-executed, without requiring generation of commands to re-execute these actions, thus assuring improved ease and operating efficiency.

Figure 12:
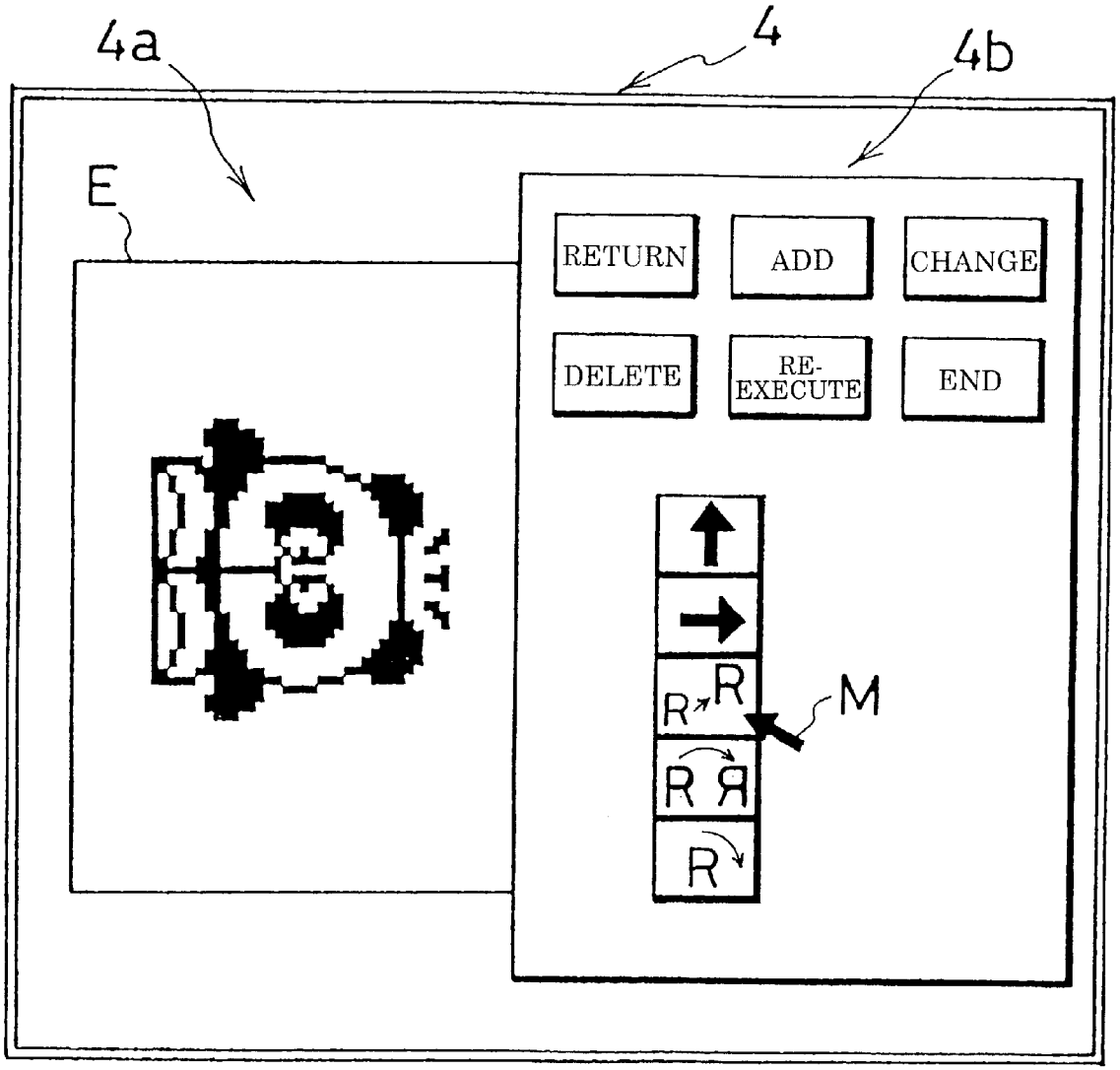
FIG. 12 is a view corresponding to that of FIG. 5, wherein the contents of editing actions are displayed in the form of icons.

In the retrospective and repetitive editing control of the illustrated embodiment, the previously executed editing action that is three steps before the current state is designated. It is, however, possible to designate a certain editing action out of a plurality of executed editing actions, by successively designating and redoing the editing actions one by one with the marker M, in the same manner as in the conventional editing apparatus. Also, as shown in FIG. 12, the contents of the editing actions that have been executed may be displayed in the form of symbols or icons representing the editing actions. In this case, the contents of the editing actions can be easily recognized at a glance, and the display region showing the contents of the editing actions can be reduced in size.

While embroidery data is returned to the state just before execution of the designated editing action in the illustrated embodiment, the data may be returned to the state just after execution of the designated editing action. While the apparatus of the illustrated embodiment is constructed such that various control programs for executing respective processes of the invention are stored in the hard disc in the illustrated embodiment, these programs may be stored in advance in the ROM. Also, the control programs may be stored in a storage medium, such as a CD ROM or a floppy disc, and read out and stored to the RAM or hard disc as needed. In addition, the invention is not limited to details of the illustrated embodiment, but may be otherwise embodied with various changes or modifications in control of each portion of the apparatus, without departing from the principle of the invention. Furthermore, the invention may be equally applied to various other types of embroidery data processing apparatus for generating or editing various types of embroidery data.

What is claimed is:

1. An embroidery data processing apparatus for generating or editing embroidery data using display means, said embroidery data representing an embroidery pattern to be formed by an embroidering machine, comprising:

edit history storage means for successively storing a plurality of editing actions in an order in which the editing actions are executed, such that each of the editing actions is stored to the edit history storage means when said each editing action is performed on an embroidery pattern displayed on said display means;

data storage means for storing embroidery data generated upon execution of each of the editing actions, as the latest embroidery data, so that the embroidery data in the data storage means is updated;

edit history display control means for causing said display means to display the editing actions stored in said edit history storage means in the form of characters or symbols, in an order in which the editing actions are stored to the edit history storage means;

editing action designating means for directly designating a selected one of a plurality of previously executed editing actions that are displayed on said display means by said edit history display control means; and embroidery data restoring means for obtaining embroidery data in a state when the editing action designated by said editing action designating means was performed, as the latest embroidery data.

2. The embroidery data processing apparatus according to claim 1, further comprising:

command generating means for generating a command for new processing on the embroidery data in the state when the editing action designated by said editing action designating means was performed; and an editing action re-executing means for successively re-executing the previously executed editing actions that follow the editing action designated by said editing action designating means, when the new processing is effected in response to the command generated by said command generating means.

3. The embroidery data processing apparatus according to claim 2, wherein the new processing according to the command generated by said command generating means comprises at least one of an addition of a new editing action, deletion of the editing action designated by said editing action designating means, and a change in the editing action designated by said editing action designating means.

4. The embroidery data processing apparatus according to claim 1, wherein said edit history display control means causes said display means to display contents of the editing actions that are represented by symbols comprising icons.

5. The embroidery data processing apparatus according to claim 2, wherein said edit history display control means causes said display means to display contents of the editing actions in the form of symbols comprising icons.

6. A computer-readable storage medium that stores an embroidery data processing program for generating or editing embroidery data using display means, said embroidery data representing an embroidery pattern to be formed by an embroidering machine, the embroidery data processing program comprising:

an edit history storage routine for successively storing a plurality of editing actions in an order in which the editing actions are executed, such that each of the editing actions is stored to an edit history storage means when said each editing action is performed on an embroidery pattern displayed on said display means;

a data storage routine for storing embroidery data generated upon execution of each of the editing actions, as the latest embroidery data, so that the embroidery data in a data storage means is updated;

an edit history display control routine for causing said display means to display the editing actions stored in said edit history storage means in the form of characters or symbols, in an order in which the editing actions are stored in the edit history storage means;

an editing action designating routine for directly designating a selected one of a plurality of previously executed editing actions that are displayed on said display means by said edit history display control routine; and an embroidery data restoring routine for obtaining embroidery data in a state when the editing action designated by said editing action designating routine was performed, as the latest embroidery data.

7. The computer-readable storage medium according to claim 6, further comprising:

a command generating routine for generating a command for new processing on the embroidery data in a state when the editing action designated by said editing action designating routine was performed; and an editing action re-executing routine for successively re-executing the previously executed editing actions that follow the editing action designated by said editing action designating routine, when the new processing is effected in response to the command generated by said command generating routine.

8. The computer-readable storage medium according to claim 7, wherein the new processing according to the command generated by said command generating routine comprises at least one of an addition of a new editing action, deletion of the editing action designated by said editing action designating routine, and a change in the editing action designated by said editing action designating routine.

9. The computer-readable storage medium according to claim 6, wherein said edit history display control routine causes said display means to display contents of the editing actions that are represented by symbols comprising icons.

10. The computer-readable storage medium according to claim 7, wherein said edit history display control routine causes said display means to display contents of the editing actions that are represented by symbols comprising icons.

11. A method of re-editing embroidery data of an embroidery object using an electronic processor and a display, comprising the steps of:

displaying on the display, editing commands in an order commanded;

designating an editing command in the sequence of commands subject to editing;

marking the designated editing command;

displaying the embroidery object in a state of the designated editing command;

entering one of an action command and function command;

processing the embroidery data on the basis of the entered one of the action command and the function command; and displaying the results of the processing of the embroidery data.

12. The method according to claim 11, wherein the designating, marking, displaying the embroidery object, processing, and displaying the results steps are repeated for further editing.

13. The method according to claim 12, wherein the fuiction command for entry is selected from a group comprising "REVIEW", "RE-EXECUTE" and "END".

14. The method according to claim 11, wherein the action command is selected from a group comprising "ADD", "DELETE", and "CRANGE".

15. The method according to claim 13, wherein the entering of the "RE-EXECUTE" command comprises the step of processing all subsequent editing commands and displaying a resultant embroidery object.

16. The method according to claim 14, wherein the action commands of "DELETE" and "CHANGE" are processing steps to respectively delete the marked editing command and change the marked editing command.

17. The method according to claim 14, wherein the action command of "ADD" is a step creating a space for a new editing command in the displayed editing commands immediately before the marked editing command.

18. The method according to claim 17, further comprising a step of entering an editing command to the displayed editing commands at the space for execution.

* * * * *